US008662152B2

(12) United States Patent
Arvidsson

(10) Patent No.: US 8,662,152 B2
(45) Date of Patent: Mar. 4, 2014

(54) PLATE HEAT EXCHANGER

(75) Inventor: Camilla Arvidsson, Bjärred (SE)

(73) Assignee: Alfa Laval Corporate AB, Lund (SE)

( * ) Notice: Subject to any disclaimer, the term of this patent is extended or adjusted under 35 U.S.C. 154(b) by 1169 days.

(21) Appl. No.: 12/524,486

(22) PCT Filed: Feb. 25, 2008

(86) PCT No.: PCT/SE2008/000153

§ 371 (c)(1),
(2), (4) Date: Aug. 20, 2009

(87) PCT Pub. No.: WO2005/038377

PCT Pub. Date: Apr. 28, 2005

(65) Prior Publication Data

US 2010/0006275 A1 Jan. 14, 2010

(30) Foreign Application Priority Data

Feb. 26, 2007 (SE) ..... 0700471

(51) Int. Cl.
*F28D 9/00* (2006.01)

(52) U.S. Cl.
USPC ..... 165/167; 165/906; 165/916

(58) Field of Classification Search
USPC ..... 165/167, 906, 916
See application file for complete search history.

(56) References Cited

U.S. PATENT DOCUMENTS 4,742,866 A * 5/1988 Yamanaka et al. ..... 165/283
4,987,955 A * 1/1991 Bergqvist et al. ..... 165/167
5,462,113 A * 10/1995 Wand ..... 165/167
5,931,219 A * 8/1999 Kull et al. ..... 165/51
5,988,269 A * 11/1999 Karlsson et al. ..... 165/167

(Continued)

FOREIGN PATENT DOCUMENTS

DE 19523475 11/1996
EP 0 347 961 A1 12/1989

(Continued)

OTHER PUBLICATIONS

Written Opinion of the International Searching Authority for PCT/SE2008/000153.

(Continued)

*Primary Examiner* — Allen Flanigan
(74) *Attorney, Agent, or Firm* — Buchanan Ingersoll & Rooney PC

(57) ABSTRACT

A plate heat exchanger (100) including a number of heat exchanger plates (1), which are arranged beside each other and connected to each other by means of a braze connection to form a stack of plates (2), wherein the heat exchanger plates are substantially manufactured in stainless steel containing chromium, wherein the plate heat exchanger (100) includes a number of port channels extending through at least some of the heat exchanger plates (1), and wherein the plate heat exchanger (100) further including end plates (3, 5) covering each end of the stack of plates (2) and having port holes associated with the port channels, where at least one end plate (3, 5) has at least one port hole provided with a cover (9, 12) and where said cover includes means (9, 12) for increasing the strength and means (14, 15) for sealing off the at least one end plate (3, 5) against an adjacently arranged heat exchanger plate.

11 Claims, 4 Drawing Sheets

(56) References Cited

U.S. PATENT DOCUMENTS

| | | | | |
|---|---|---|---|---|
| 7,740,058 | B2 * | 6/2010 | Koepke et al. | 165/167 |
| 8,181,696 | B2 * | 5/2012 | Rassmus | 165/167 |
| 2003/0201094 | A1 | 10/2003 | Evans et al. | |
| 2007/0023175 | A1 * | 2/2007 | Richter | 165/167 |
| 2008/0190595 | A1 * | 8/2008 | Sjodin et al. | 165/167 |
| 2008/0216987 | A1 * | 9/2008 | Thumm et al. | 165/67 |
| 2008/0257536 | A1 * | 10/2008 | Kolblin et al. | 165/167 |

FOREIGN PATENT DOCUMENTS

| | | | |
|---|---|---|---|
| EP | 0676608 | | 10/1995 |
| EP | 742418 | A2 * | 11/1996 |
| EP | 0 866 300 | | 9/1998 |
| EP | 1 241 427 | | 9/2002 |
| EP | 1562014 | | 8/2005 |
| GB | 758133 | | 9/1956 |
| KR | 10-2006-0113896 | A | 11/2006 |
| WO | 88/09474 | | 12/1988 |
| WO | 2002/061357 | | 8/2002 |
| WO | 2005/038377 | | 4/2005 |
| WO | WO 2005071342 | A1 * | 8/2005 |
| WO | 2006/126931 | | 11/2006 |

OTHER PUBLICATIONS

International Search Report for PCT/SE2008/000153.

Office Action (Notice of Preliminary Rejection) issued on Dec. 9, 2013, by the Korean Patent Office in corresponding Korean Patent Application No. 10-2009-7017561, and an English Translation of the Office Action. (5 pages).

* cited by examiner

PLATE HEAT EXCHANGER

BACKGROUND OF THE INVENTION

The present invention relates to a plate heat exchanger, and more specifically to an arrangement of the frame plate and the pressure plate of a plate heat exchanger.

BACKGROUND OF THE INVENTION

To improve plate heat exchangers and their design one way is to reduce the thickness of the heat exchanger plates to save material and costs. Reducing the thickness, however, lower the strength of heat exchanger plates. In some plate heat exchangers are also used a number of different heat exchanger plates, such as a brazed plate heat exchanger including a front plate, channel plates or heat exchanger plates, a sealing plate and a pressure plate, all stacked on top of one another. There is a desire of reducing the number of different heat exchanger plates in the plate heat exchanger, simplify the design and also to save costs.

EP-A2-0 866 300 describes an oil cooler comprising a stack of heat exchanger plates, a frame plate and a pressure plate. The heat exchanger plates are arranged beside each other and forms a first plate space for the oil and a second plate space for a cooling media. The frame plate and each of the heat exchanger plates is provided with four port holes, which creates four port channels extending through the frame plate and the heat exchanger plates. The pressure plate is reinforced by a deformation adjacent to the port channel.

EP-A1-1 241 427 describes a plate-type heat exchanger consisting of an essentially even number of heat exchanger plates. The plate heat exchanger further comprise a frame plate and a pressure plate, where the pressure plate is strengthened by deformations adjacent to port channel formed by port holes in the frame plate and the heat exchanger plates.

US-A1-2007/0023175 describes a stacked plate heat exchanger including a multiplicity of stacking plates, metal turbulence plates arranged between the stacking plates, base plate, a cover plate and an intermediate metal plate arranged between the uppermost stacking plate and the cover plate. The cover plate is provided with stamped formations directed and extending into the port channels and serving as strengthen parts of the cover plate.

SUMMARY OF THE INVENTION

A first object of this invention is to remedy the problems mentioned above. More precisely, the object is to provide a plate heat exchanger being designed to withhold the pressure applied and that has a simplified design to reduce the number of needed different plates.

This object is achieved by the plate heat exchanger initially defined, which is characterized in that at least one end plate has at least one port hole provided with a cover and where said cover includes means for increasing the strength and means for sealing off the at least one end plate against an adjacently arranged heat exchanger plate.

According to another aspect of the invention, the strengthen means included in the plate heat exchanger is formed as a surface of the end plate that deviates from a longitudinal direction of the end plate surface.

According to yet another aspect of the invention, the strengthen means included in the plate heat exchanger is formed as a curved surface of the port hole cover forming a buckle or dome, said buckle or dome extending away from the adjacent heat exchanger plate.

According to still another aspect of the invention, the means for sealing off the at least one end plate against an adjacently arranged heat exchanger plate included in the plate heat exchanger is formed as a depressed area of the port hole cover forming a ring-shaped depressed area, said ring-shaped depressed area sealing off against the adjacently arranged heat exchanger plate.

According to yet another aspect of the invention, the means for sealing off the at least one end plate against an adjacently arranged heat exchanger plate included in the plate heat exchanger is formed as a ring-shaped depressed area of the port hole cover, and where said ring-shaped depressed area are connected to the adjacently arranged heat exchanger plate by brazing.

According to still another aspect of the invention, two port holes of one of the end plates in the plate heat exchanger are provided with covers having means for increasing the strength and having means for sealing off the one end plate against an adjacently arranged heat exchanger plate.

According to yet another aspect of the invention, both of the end plates in the plate heat exchanger are provided with covers covering at least one port hole of the end plate, and where each cover includes means for increasing the strength and means for sealing off the end plate against an adjacently arranged heat exchanger plate.

According to still another aspect of the invention, the cover, the means for increasing the strength of the cover and the means for sealing off the at least one end plate against an adjacently arranged heat exchanger plate in the plate heat exchanger are integrated parts of the end plate.

Further aspects of the invention are defined in the dependent claims.

BRIEF DESCRIPTION OF THE DRAWINGS

In the following, the invention will be explained more with reference to the accompanying drawings, where.

DETAILED DESCRIPTION OF EMBODIMENTS

Figure 5:
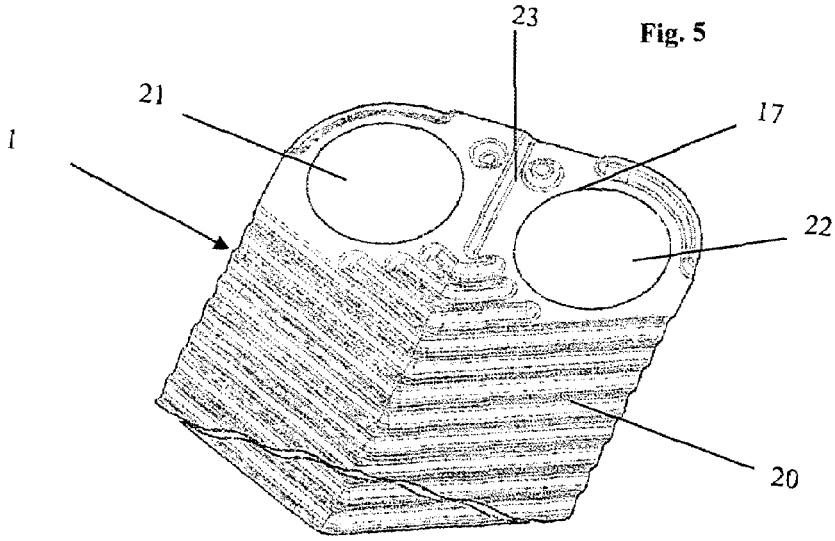
FIG. 5 discloses a partial perspective view of a heat exchanger plate.

FIGS. 1 to 4 disclose different views of a plate heat exchanger according to the invention. The plate heat exchanger 100 includes a number of heat exchanger plates 1, which are arranged beside each other to form a plate package or plate stack 2. Each heat exchanger plate 1 includes in a manner known per se a corrugation or pattern for increasing the heat transfer. In FIG. 5 a example of a heat exchanger plate 1 is shown. The pattern comprise crests and valleys, which on mutually adjacent plates abut against one another locally so as to constitute contact points which in a known manner are used for connecting the plates to one another during the brazing or soldering together of the plate heat exchanger 100. Flow channels are in a known manner formed between mutually adjacent plates 1 in a plate stack 2 comprising a number of plates stacked on one another. Mutually adjacent flow channels accommodate different media between which there is temperature exchange through the heat transfer surfaces of the plates. The heat exchanger plate 1 includes four port holes 6-7 and 10-11 for forming a corresponding number of port channels 16, 18 extending through the plate package 2 and being in connection with the flow channels formed between the heat exchanger plates 1. It is to be noted that the plate package 2 may include another number of port channels than the four disclosed in the shown embodiments.

The plate package 2 includes a first outer heat exchanger plate or frame plate 3 and a second outer heat exchanger plate or pressure plate 5. Between these outer heat exchanger plates 3, 5 the remaining heat exchanger plates 1 are arranged.

In the embodiments disclosed, both the frame plate 3 and the pressure plate 5 have been provided with port holes aligned to the port channels 16, 18, and connection pipes attached to two of the port holes. In many applications only one of the frame plate 3 and the pressure plate 5 are provided with port holes and thereto attached connection pipes 8, 13. In the shown embodiment, however, both the frame plate 3 and the pressure plate 5 are provided with port holes 6-7 and 10-11 and thereto attached connections 8, 13. It is also possible that an uneven number of connection pipes 8, 13 can be attached port holes of either of the frame plate 3 or the pressure plate 5, or any other combination thereof.

The heat exchanger plates 1, the frame plate 3 and the pressure plate 5 are arranged in such a way that they extend substantially in parallel to a common main extension plane.

The heat exchanger plates 1, 3 and 5 are substantially manufactured in stainless steel containing chromium. The heat exchanger plates 1 are connected to each other by means of a braze connection. The brazing takes place by means of a braze material based on or containing copper, nickel, iron or silver and possibly any possible flux agent that can contain fluorine. A thin foil or paste of the braze material is positioned in each interspace between the heat exchanger plates 1. Thereafter, the plate package 2 could be compressed.

The plate package 2 may by placed in a closed space (not disclosed), such as a vacuum furnace, during vacuum-like pressure conditions or in a gas atmosphere consisting of a substantially inert gas or a reducing gas, and a desired braze temperature which may be up to about 1100° C. with copper as braze material and about 1200° C. with nickel as braze material.

Figure 1:
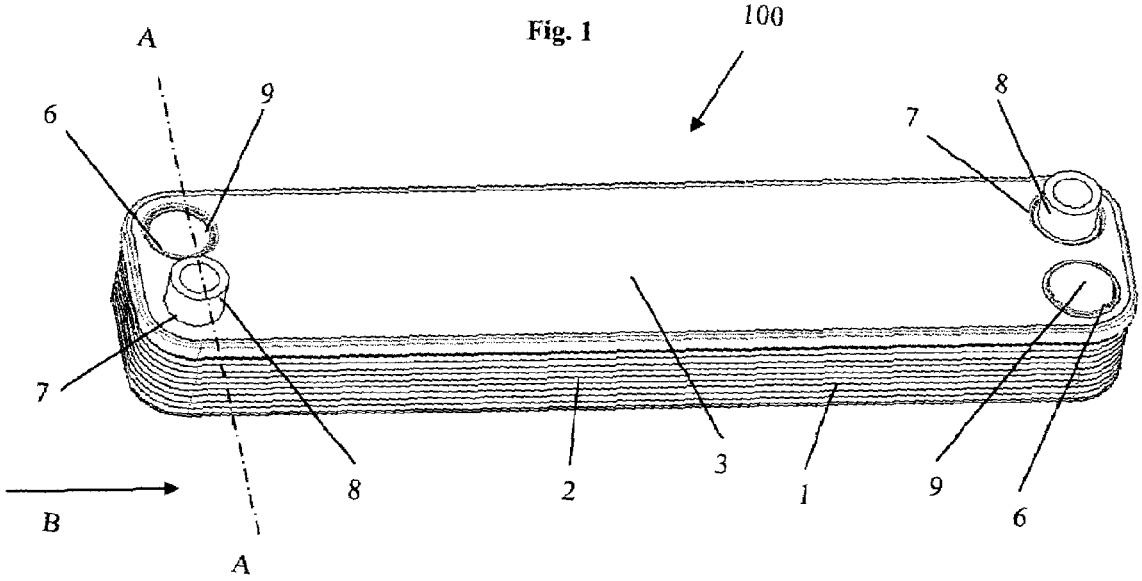
FIG. 1 discloses a perspective front view a plate heat exchanger according to the invention.

In FIG. 1 a plate heat exchanger 100 is shown including a plate heat exchanger 100 with a frame plate 3 having four port holes 6, 7 on its upper side, where the frame plate 3 with lower side is attached to a stack 2 of heat exchanger plates 1. The port holes 7 are provided with connections 8 and the port holes 6 are covered by buckle-shaped or dome-shaped covers 9.

Figure 2:
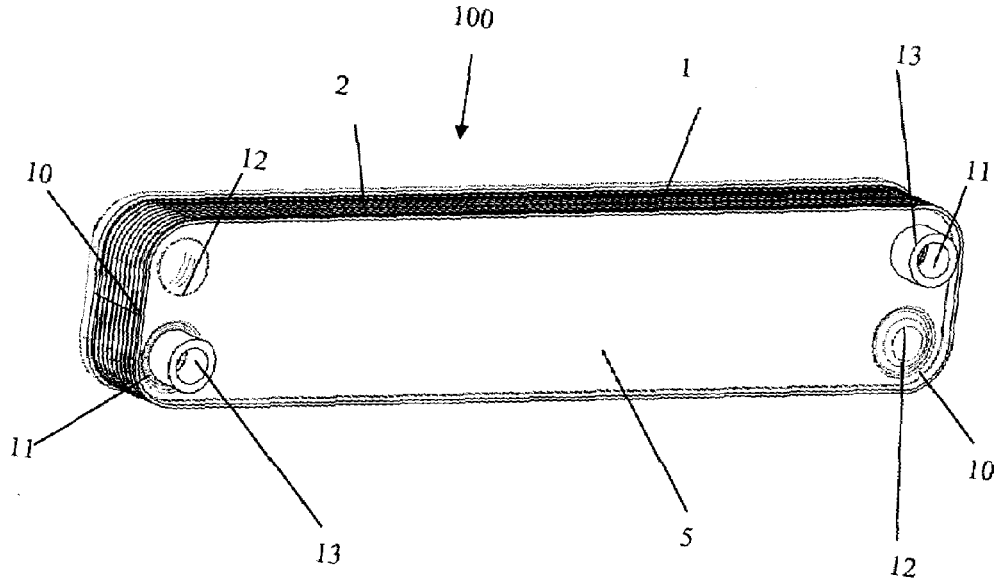
FIG. 2 discloses a perspective rear view of a plate heat exchanger according to the invention.

In FIG. 2 the plate heat exchanger 100 is shown from the rear with the pressure plate 5 visible, where the pressure plate 5 is attached with one side to the other surface the stack of heat exchanger plates 1. The other side of the pressure plate 5, which is visible, is provided with four port holes 10, 11. The port holes 11 are provided with connections 13 and the port holes 10 are covered by dome-shaped covers 12.

Figure 3:
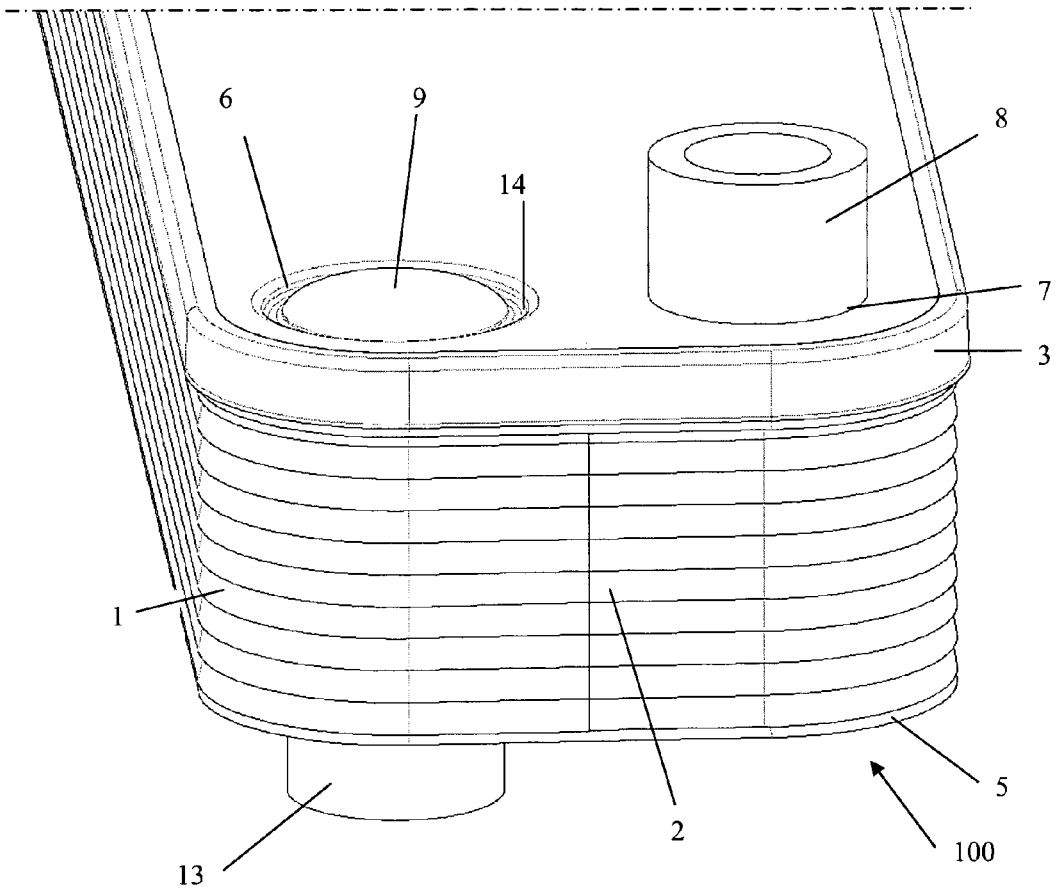
FIG. 3 discloses a partial perspective front view of a plate heat exchanger according to the invention as shown in FIG. 1.

In FIG. 3 a partial enlarged view of the plate heat exchanger 100 is shown, where a connection pipe 8 and a dome-shaped cover 9 provided on the frame plate 1 are visible. A connection pipe 13 connected to one of the port holes 11 of the rear pressure plate 5 is partially visible. The dome-shaped cover 9 is surrounded by or having its circumferential formed as a ring-shaped embossing 14 that is depressed in the frame plate 3. This is better shown in FIG. 4. The ring-shaped embossing 14 serves to seal the frame plate 3 against the adjacently arranged heat exchanger plate 1 or more specifically against the edges 17 of the port hole thereof.

Figure 4:
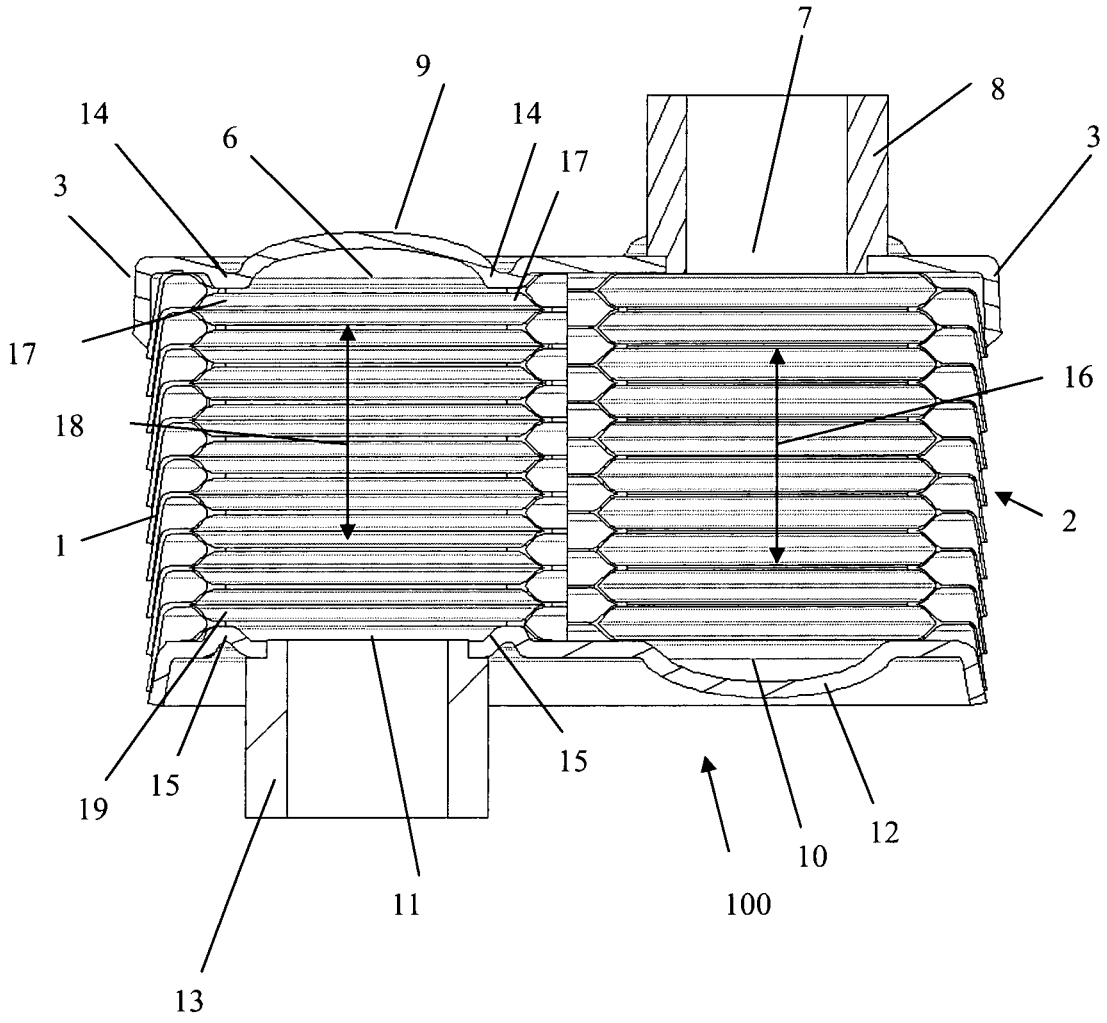
FIG. 4 discloses schematically a cross section view of a plate heat exchanger according to the invention provided with connection pipes.

In FIG. 4 a cross-section of the plate heat exchanger 100 of FIG. 1 is shown, seen along the line A-A and in the direction B. The frame plate 3 is shown with a dome-shaped cover 9 having an embossing 14 surrounding the dome on each side, both covering the port hole 6, and a connection pipe 8 attached to the port hole 7. The connection pipe 8 is an inlet or outlet of the port channel 16 formed by the port holes of the heat exchanger plates 1, where the port channel 16 is in connection the flow channels that are in a known manner formed between mutually adjacent heat exchanger plates 1 in the plate stack 2 and accommodating a first fluid. The frame plate 3 is attached to the upper most heat exchanger plate 1 of the plate stack 2. The embossing 14 seals off against edges or flange 17 of the port hole 6 of the uppermost arranged heat exchanger plate 1. The heat exchanger plate 1 is discussed further later.

The connection pipe 13 of FIG. 4 can as earlier been discussed also be attached to the port hole 10 and the port hole 11 could be provided with a dome-shaped cover 12. Like-vise the connection 8 and the dome-shaped cover 9 can be arranged differently, or can all port holes that are shown in FIG. 4 be provided with dome-shaped covers or connection pipes, or any other combination. Normally, the plate heat exchanger 100 has four connection pipes attached to the possible port holes and these connections can be configured to any of the possible port holes to suit best the application of the plate heat exchanger 100.

The pressure plate 5 is shown provided with a dome-shaped cover 12 covering the port hole 10, and a connection pipe 13 attached to the port hole 11. The connection pipe 13 is an inlet or outlet of the port channel 18 formed by the port holes of the heat exchanger plates 1, where the port channel 18 is in connection the flow channels that are in a known manner formed between mutually adjacent heat exchanger plates 1 in the plate stack 2 and accommodating a second fluid. The pressure plate 5 is attached by brazing to the lowermost heat exchanger plate 1 of the plate stack 2. The embossing 15 seals off against edges or flange 19 of the port hole 11 of the lowermost arranged heat exchanger plate 1. The connection pipe 13 is attached to the edges or flanges of the port hole 11 of the pressure plate 5.

In FIG. 5 a partial view of a heat exchanger plate 1 to be used in a plate heat exchanger 100 according to the invention is shown. The heat exchanger plate 1 comprises as earlier mentioned two port holes 21, 22 in each end of the heat exchanger plate 1 and a heat transfer surface 20 arranged there between. The heat transfer surface 20 is as earlier described configured as a corrugation or pattern for increasing the heat transfer. To enable the separate flow channels to be formed between the heat exchanger plates 1, the two adjacent port holes 21, 22 in each end of the heat exchanger plate 1 need to be sealed off from each. This accomplished by the earlier described sealing means 14, 15 in combination with port holes 21, 22 arranged in different planes. Such an arrangement of the port holes in the heat exchanger plate 1 is well known. A slope area or transition surface 23 connects the different planes in which the port holes 21, 22 are arranged. If the heat exchanger plate 1 of FIG. 5 is arranged as the uppermost located heat exchanger plate of the plate heat exchanger 100 in FIG. 4, the embossing 14 of the frame plate 3 seals off against the edge or flange 17 of the port hole 22, whereas the port hole 21 is sealed off directly against the frame plate 3. Thereby two different flow channels are created, a first flow channel accommodating a first media and being connected to the port channel 16 and a second flow channel accommodating a second media and being connected to the port channel 18.

In the description the term "cover" has been used to describe the port holes 6 and 10 that are covered and it should be understood that the "cover" is not a removable cover but an integrated part of the frame and pressure plates, respectively, that has been formed by e.g. deep-drawing or any other similar material forming processes. The forming of the frame and pressure plates, respectively, as described earlier, serves as a strengthening of a pressure-exposed part of the frame and pressure plates, respectively, as well as a sealing against an adjacently arranged heat exchanger plate. The inner or center part of the cover 9 is as earlier described dome-like and is in particular shaped as an elliptical dome. Such a shaping or forming of a relatively thin metal material provides increased strength and firmness of the product. This is needed since some of the initial or intrinsic strength of the metal material is lost during the thermal exposure that the plate heat exchanger is exposed to during the soldering or brazing process.

As the invention can be implemented on either of the frame plate or the pressure plate, or on both of them at the same time depending on where the connections are located, which varies with the specific application of the plate heat exchanger, the term "end plate" is being used as general term covering both the frame plate and the pressure plate.

In the above description of both the frame plate and the pressure plate it has been described as each of them includes four port holes, although the described embodiment includes only two true port holes on each them and two so-called port holes, where the so-called port holes in reality are shaped areas of the frame and the pressure plates in accordance with the invention and where the location of the shaped areas corresponds a virtual extension of adjacent port channels.

The invention is not limited to the embodiments described above and shown on the drawings, but can be supplemented and modified in any manner within the scope of the invention as defined by the enclosed claims.

The invention claimed is:

1. A plate heat exchanger comprising a plurality of heat exchanger plates, arranged beside each other and connected to each other by a braze connection to form a stack of plates, the heat exchanger plates being substantially manufactured in stainless steel containing chromium, the plate heat exchanger including a number of port channels extending through at least some of the heat exchanger plates, and the plate heat exchanger further including end plates covering each end of the stack of plates and having port holes associated with the port channels, wherein at least one end plate has at least one port hole provided with a cover and said cover includes means for increasing the strength of the cover and means for sealing the at least one end plate against an adjacently arranged heat exchanger plate around a port hole extending through the adjacently arranged heat exchanger plate to prevent a fluid from flowing between the at least one end plate and the adjacently arranged heat exchanger plate, and wherein the means for increasing the strength and the means for sealing are formed by surface deviations of the cover that project in opposite directions relative to a plane passing through the at least one end plate.

2. A plate heat exchanger according to claim 1, wherein the strengthening means for increasing the strength is formed as a buckle or dome extending away from the adjacent heat exchanger plate.

3. A plate heat exchanger according to claim 1, wherein the means for sealing the at least one end plate against an adjacently arranged heat exchanger plate is formed as a depressed area of the port hole cover forming a ring-shaped depressed area, said ring-shaped depressed area sealing against the adjacently arranged heat exchanger plate.

4. A plate heat exchanger according to claim 3, wherein the means for sealing the at least one end plate against an adjacently arranged heat exchanger plate is connected to the adjacently arranged heat exchanger plate by brazing.

5. A plate heat exchanger according to claim 1, wherein two port holes of one of the end plates in the plate heat exchanger are provided with covers having means for increasing the strength and having means for sealing the one end plate against an adjacently arranged heat exchanger plate.

6. A plate heat exchanger according to claim 1, wherein both of the end plates in the plate heat exchanger are provided with covers covering at least one port hole of each end plate, and wherein each cover includes means for increasing the strength and means for sealing the end plate against an adjacently arranged heat exchanger plate.

7. A plate heat exchanger according to claim 1, wherein the cover, the means for increasing the strength of the cover and the means for sealing the at least one end plate against an adjacently arranged heat exchanger plate are integrated parts of the end plate.

8. A plate heat exchanger according to claim 5, wherein the means for increasing the strength of the cover and the means sealing against an adjacently arranged heat exchanger plate comprise bent portions of the end plate.

9. A plate heat exchanger comprising:

a plurality of heat exchanger plates stacked along an axis, each heat exchanger plate including an axially-extending peripheral portion brazed to at least one adjacent heat exchanger plate;

a port hole extending through each heat exchanger plate and aligned with the port hole extending through an adjacent heat exchanger plate;

an end plate including an axially-extending peripheral portion brazed to an axially-outermost one of the heat exchanger plates, the end plate including an inner surface facing the axially-outermost heat exchanger plate;

the inner surface of the end plate including a first protrusion aligned with the port hole of the axially-outermost heat exchanger plate and extending along the axial direction away from the axially-outermost heat exchanger plate; and the inner surface of the end plate including a second protrusion extending along the axial direction toward the axially-outermost heat exchanger plate, the protrusion sealingly engaging the axially-outermost heat exchanger plate to form a seal around the port hole of the axially-outermost heat exchanger plate.

10. The plate heat exchanger of claim 9, wherein the protrusion is configured to prevent a fluid flowing through the port hole of the axially-outermost heat exchanger plate from flowing between the end plate and the axially-outermost heat exchanger plate.

11. The plate heat exchanger of claim 9, wherein the protrusion is ring-shaped when viewed along the axial direction.

* * * * *